US006439702B1

(12) United States Patent
Karlinski

(10) Patent No.: US 6,439,702 B1
(45) Date of Patent: Aug. 27, 2002

(54) INKJET PRINT HEAD

(75) Inventor: Haggai Karlinski, Ramat Gan (IL)

(73) Assignee: Aprion Digital Ltd., Netanya (IL)

( * ) Notice: Subject to any disclaimer, the term of this patent is extended or adjusted under 35 U.S.C. 154(b) by 0 days.

(21) Appl. No.: 09/430,016

(22) Filed: Oct. 29, 1999

Related U.S. Application Data

(63) Continuation-in-part of application No. 09/330,217, filed on Jun. 11, 1999, which is a continuation of application No. 08/276,572, filed on Jul. 18, 1994, now Pat. No. 5,940,099.

(51) Int. Cl.[7] ..... B41J 2/045
(52) U.S. Cl. ..... 347/70
(58) Field of Search ..... 347/68, 85, 93, 347/94, 45

(56) References Cited

U.S. PATENT DOCUMENTS

| | | | | |
|---|---|---|---|---|
| 5,610,645 A | | 3/1997 | Moore et al. | |
| 5,653,901 A | | 8/1997 | Yoshimura | |
| 5,905,515 A | * | 5/1999 | Yoshimura | 347/45 |
| 5,940,099 A | * | 8/1999 | Karlinski | 347/70 |

FOREIGN PATENT DOCUMENTS

| | | |
|---|---|---|
| EP | 0 726 151 | 8/1996 |

* cited by examiner

*Primary Examiner*—John Barlow
*Assistant Examiner*—Lyke Tran
(74) *Attorney, Agent, or Firm*—Eitan, Pearl, Latzer & Cohen-Zedek

(57) ABSTRACT

An inkjet printing head including an ink supply layer formed with a plurality of connecting bores aligned so as to connect between ink cavities in a cavity layer on its rear side and corresponding ejection nozzles in a nozzle layer on its front side. The ink supply layer is formed from a porous material having a multitude of small interconnected pores so as to allow passage of ink therethrough. The ink supply layer features a number of ink inlet bores passing from its rear surface to its front surface and in direct fluid communication with a pattern of ink distribution channels formed in the front surface. The ink distribution channels and ink inlet bores together define part of an ink flow path along which ink supplied from an external ink supply passes from the rear surface through the ink inlet bores to the pattern of ink distribution channels on the front surface, and through the porous material to the ink cavities.

11 Claims, 20 Drawing Sheets

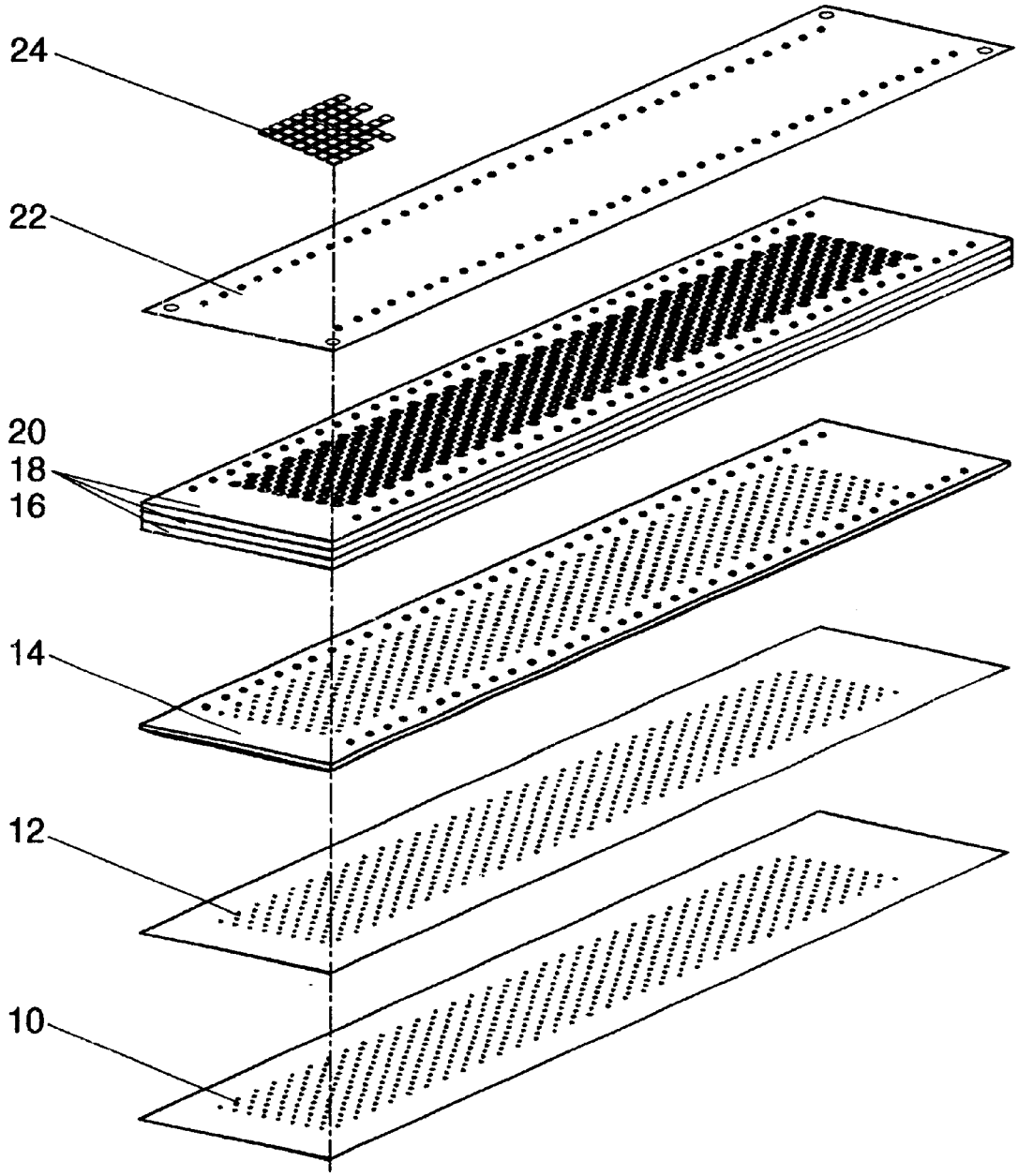
FIG. 1-A

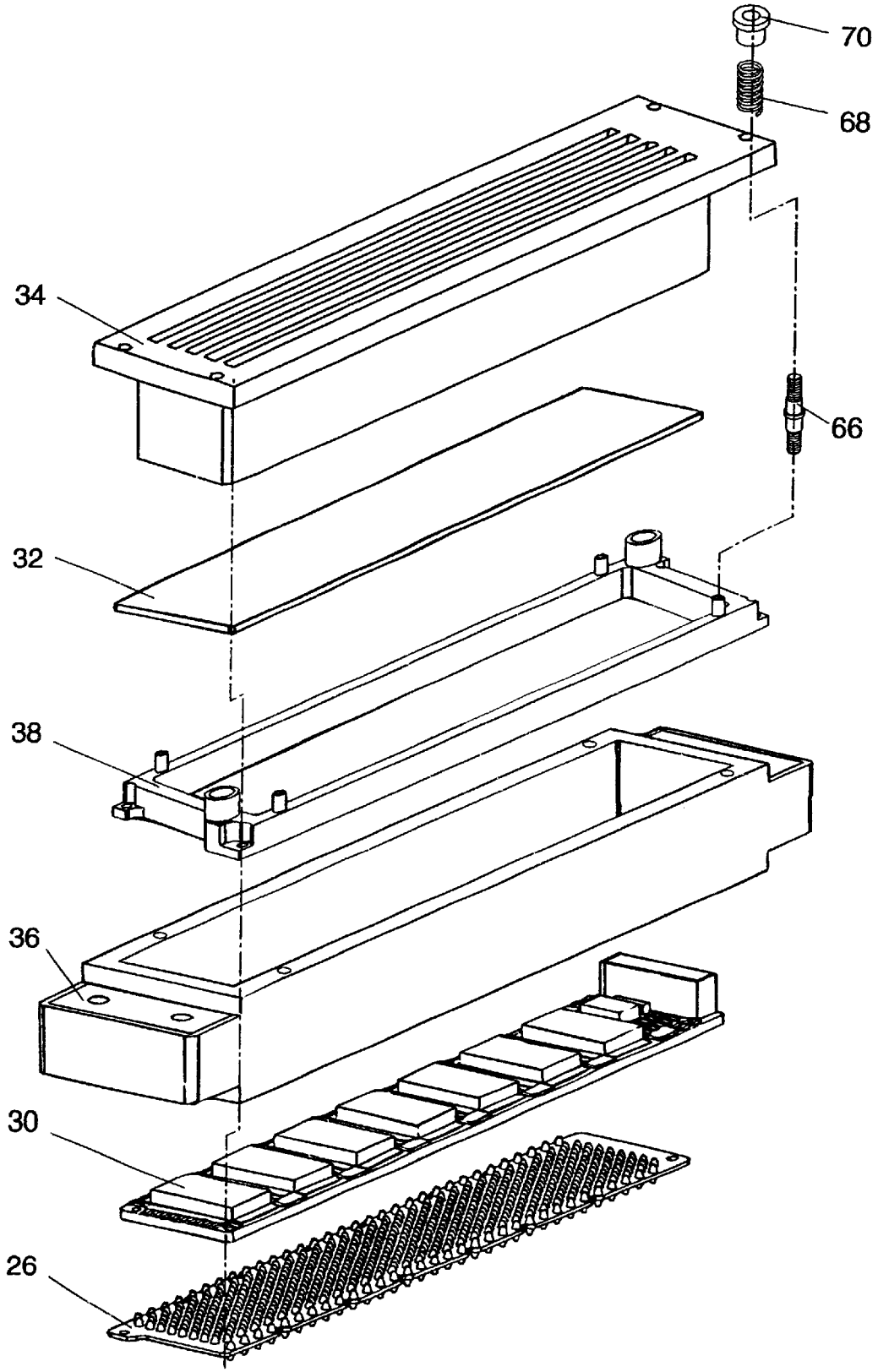
FIG. 1-B

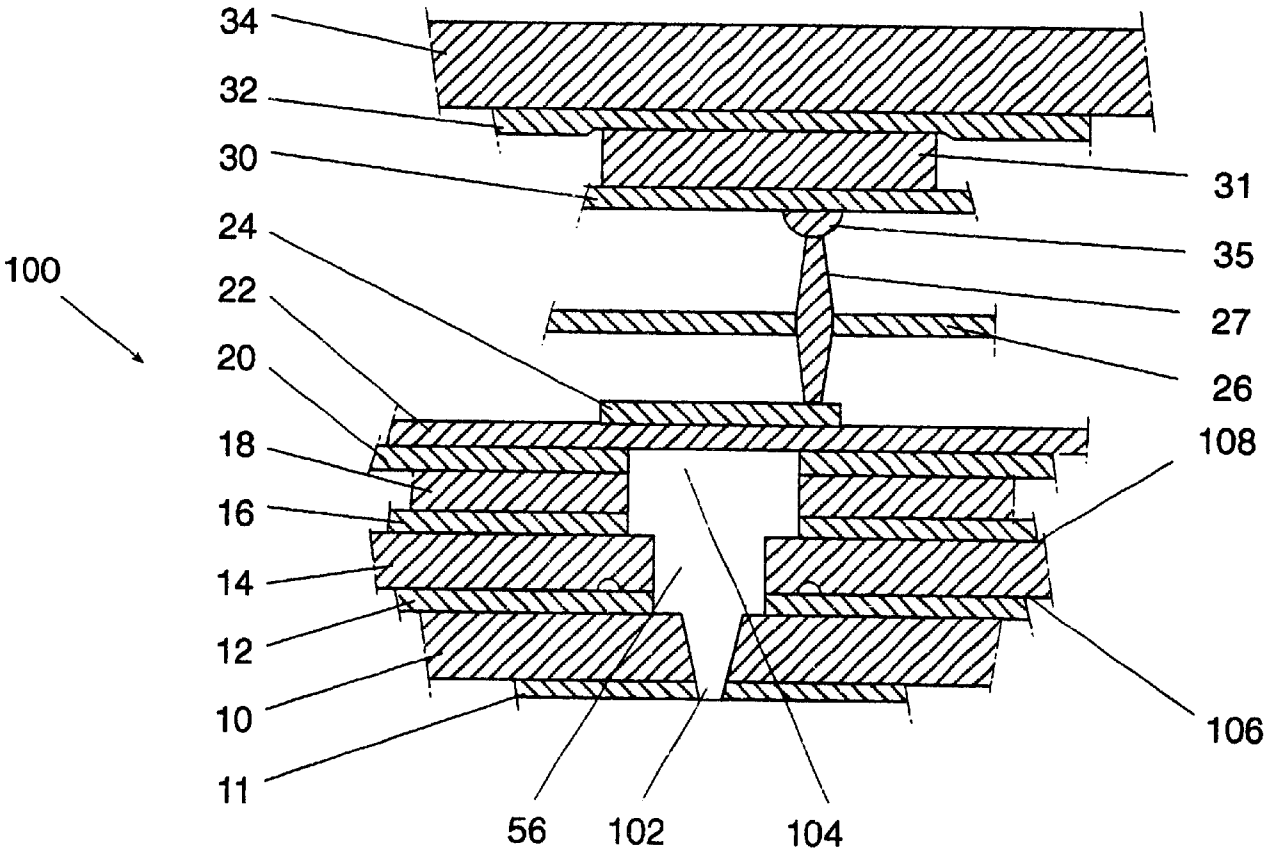
FIG. 1-C

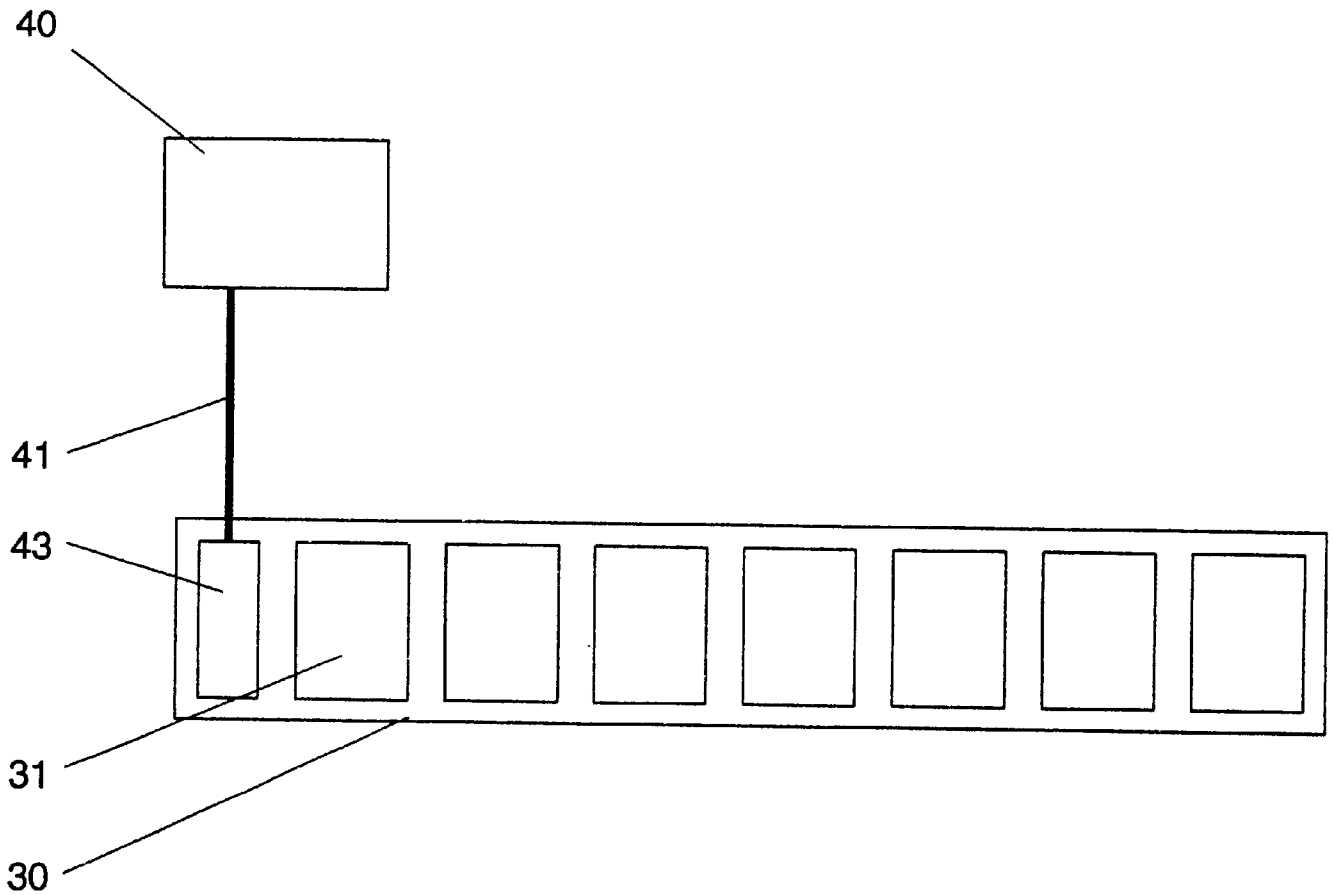
FIG. 1-D

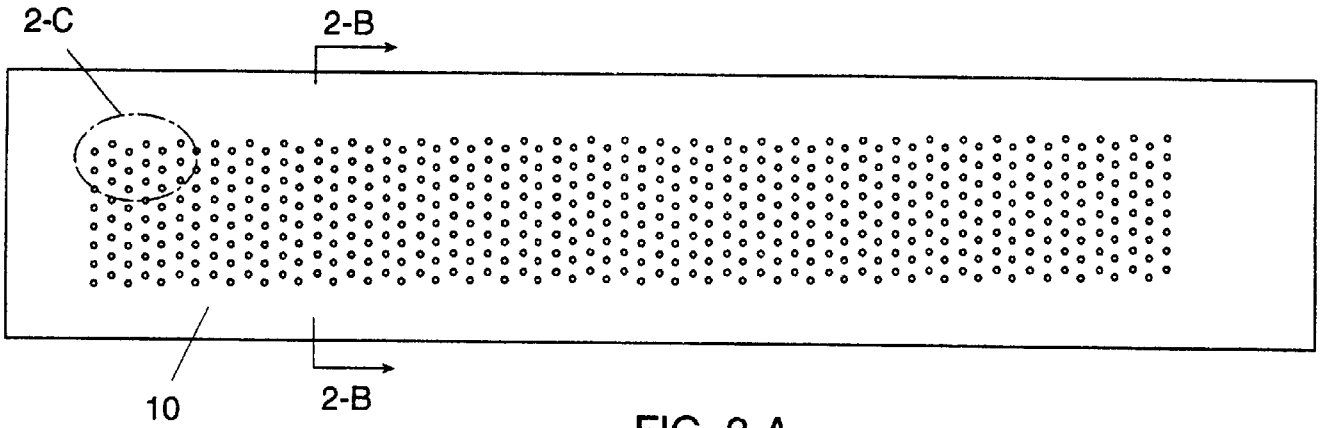
FIG. 2-A
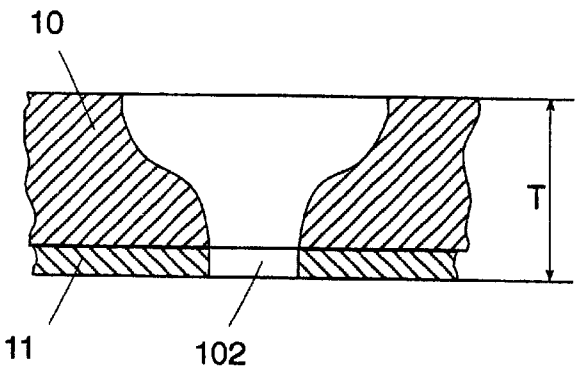
FIG. 2-B
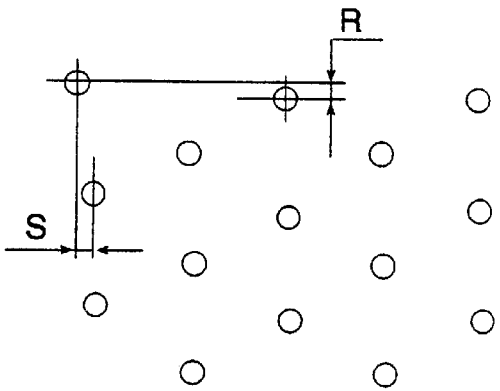
FIG. 2-C

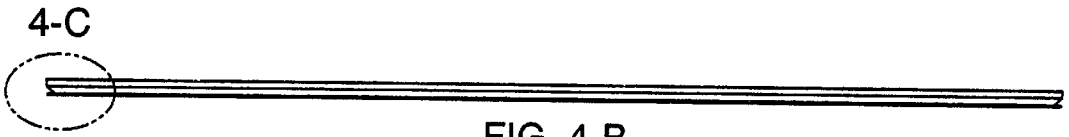
FIG. 4-B
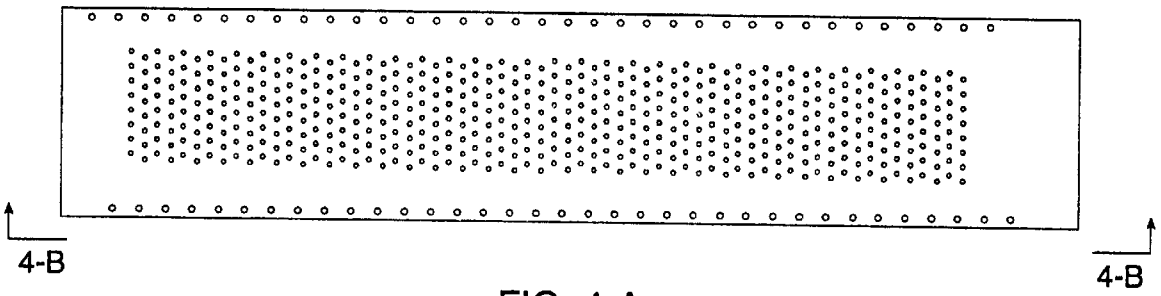
FIG. 4-A
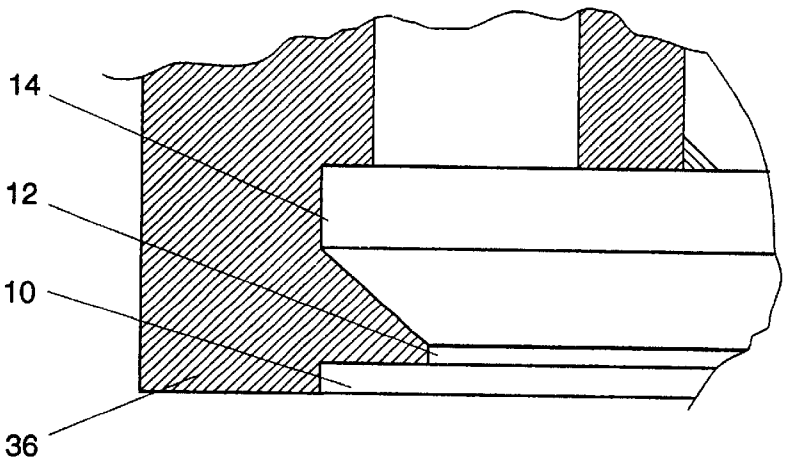
FIG. 4-C

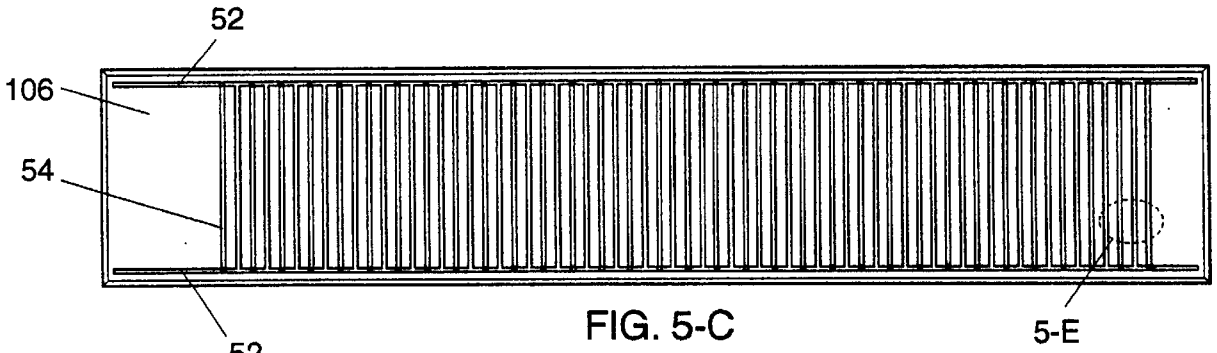
FIG. 5-C
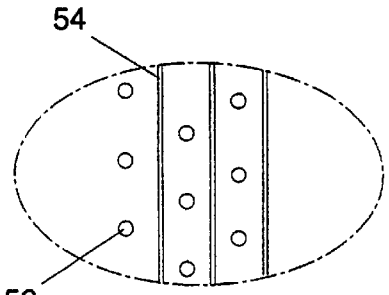
FIG. 5-E
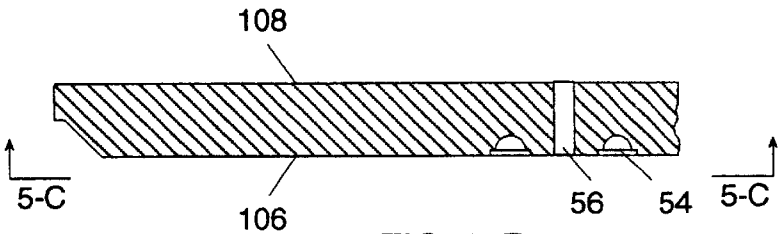
FIG. 5-B
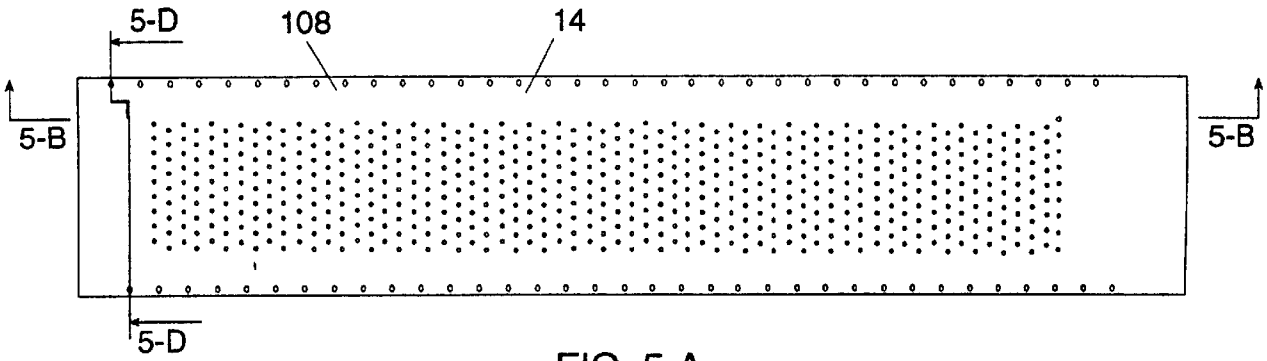
FIG. 5-A
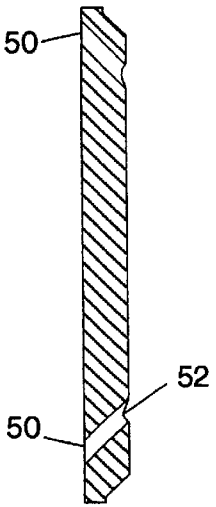
FIG. 5-D

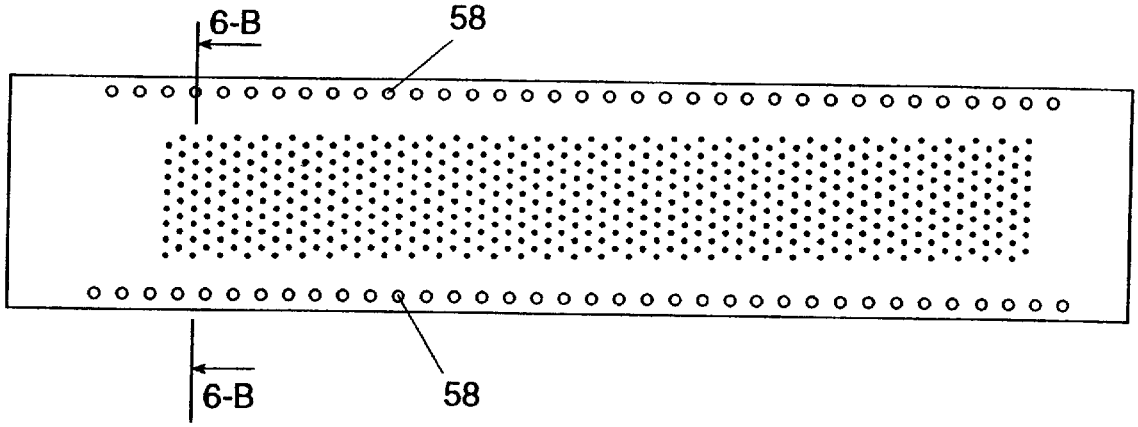
FIG. 6-A
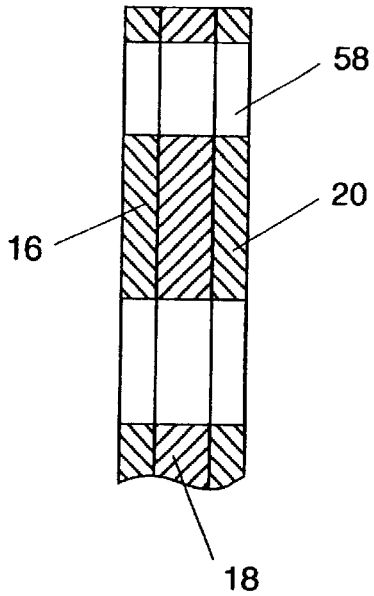
FIG. 6-B

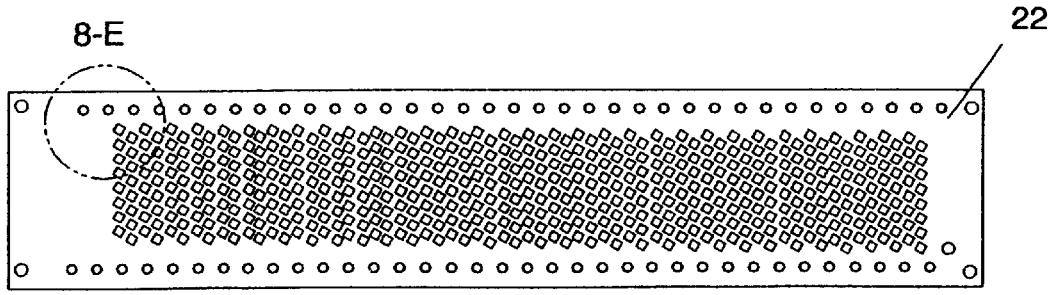
FIG. 8-C
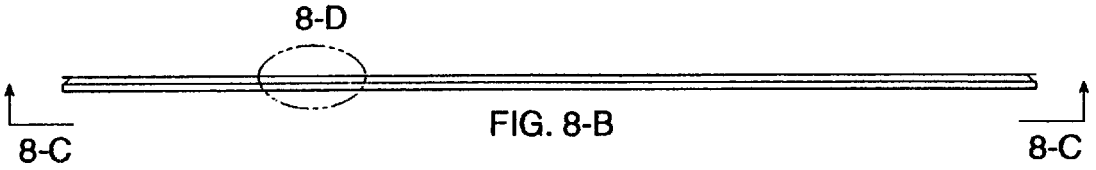
FIG. 8-B
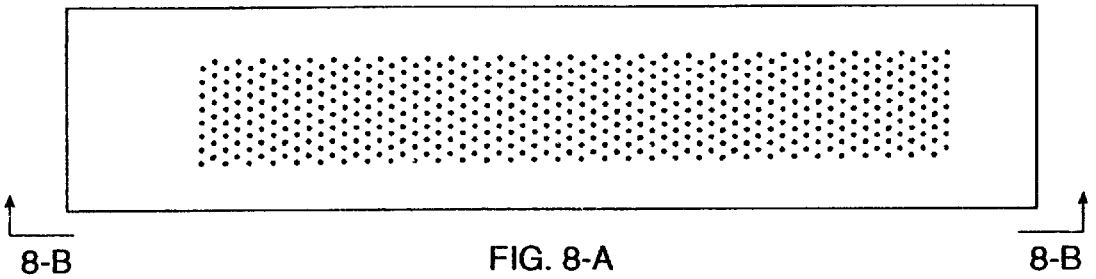
FIG. 8-A
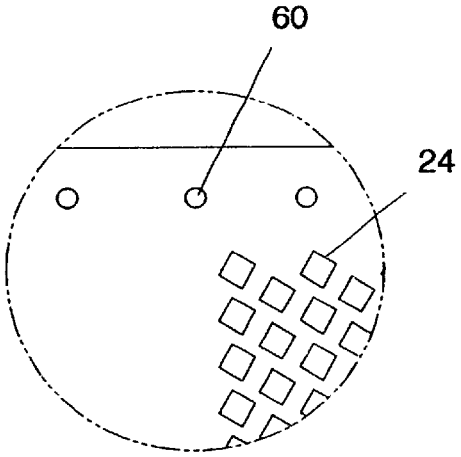
FIG. 8-E
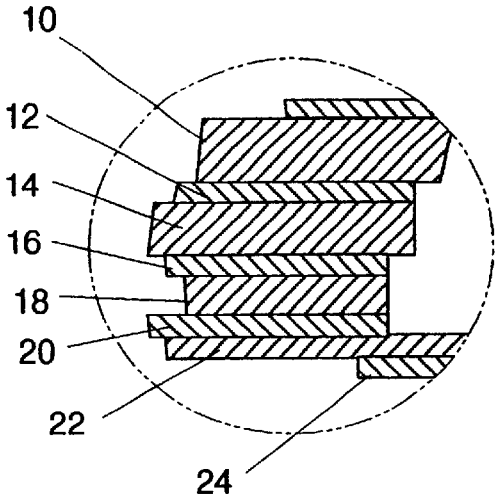
FIG. 8-D

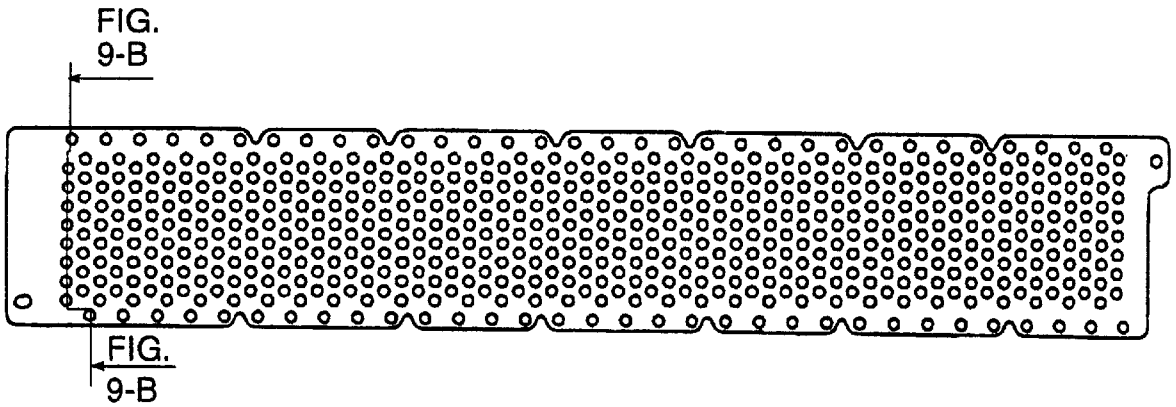
FIG. 9-A
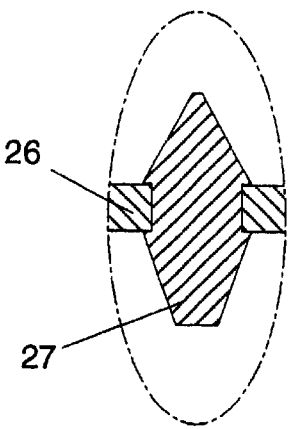
FIG. 9-D
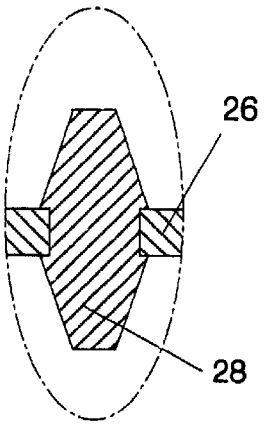
FIG. 9-C
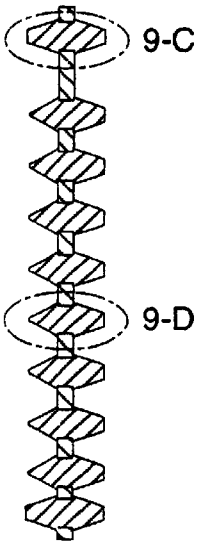
FIG. 9-B

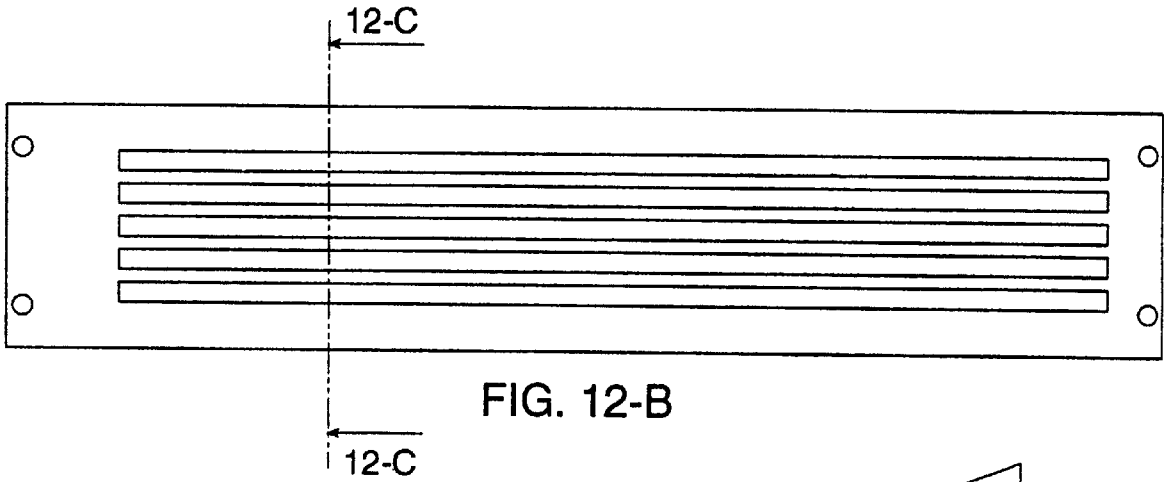
FIG. 12-B
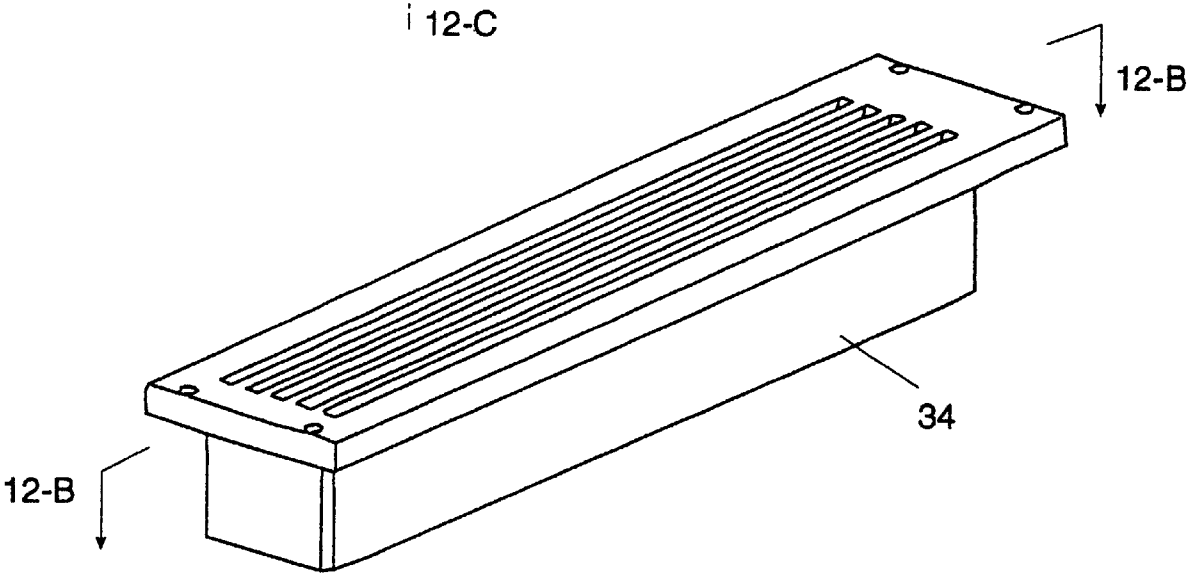
FIG. 12-A
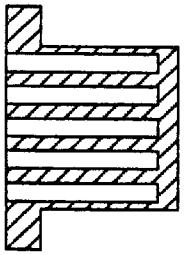
FIG. 12-C

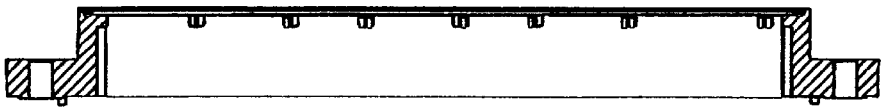
FIG.13-C
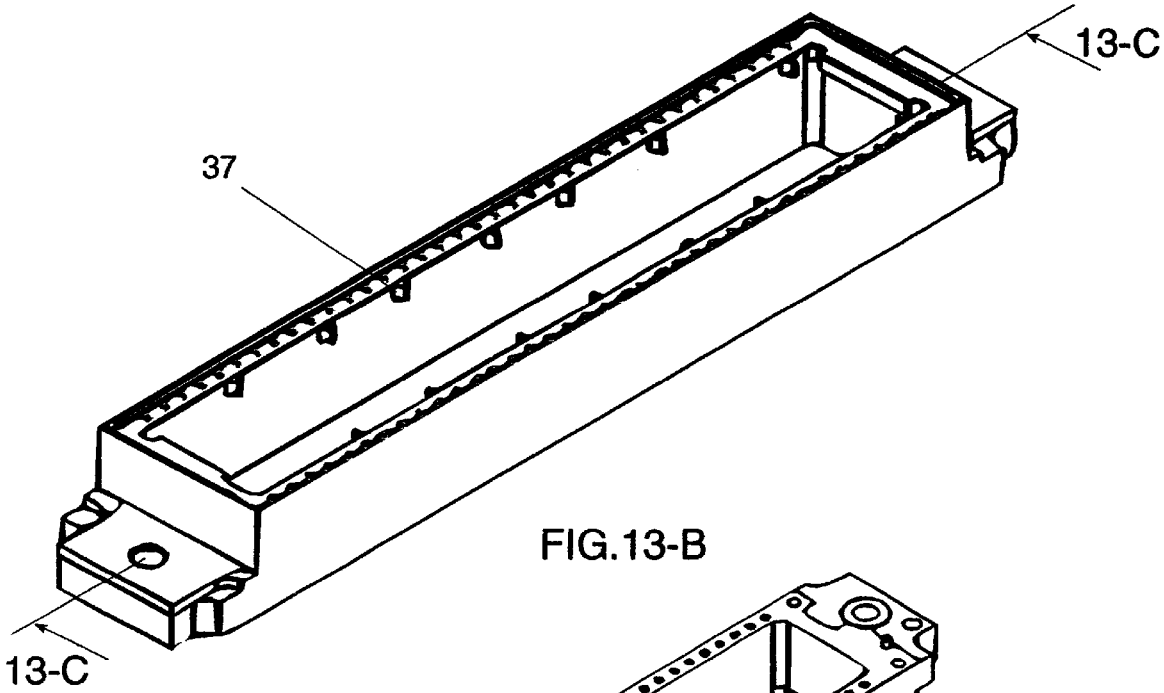
FIG.13-B
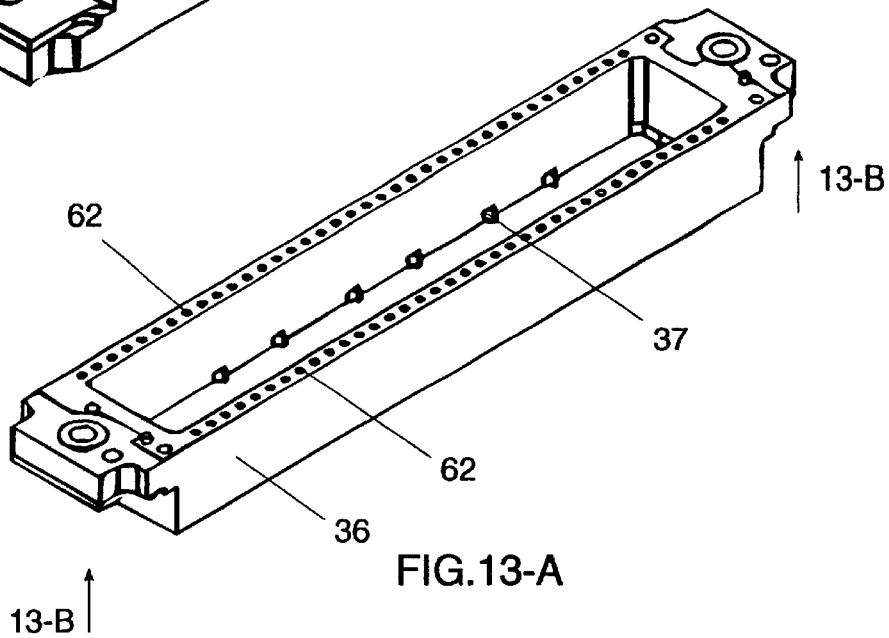
FIG.13-A

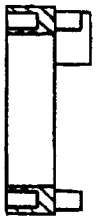
FIG. 14-C
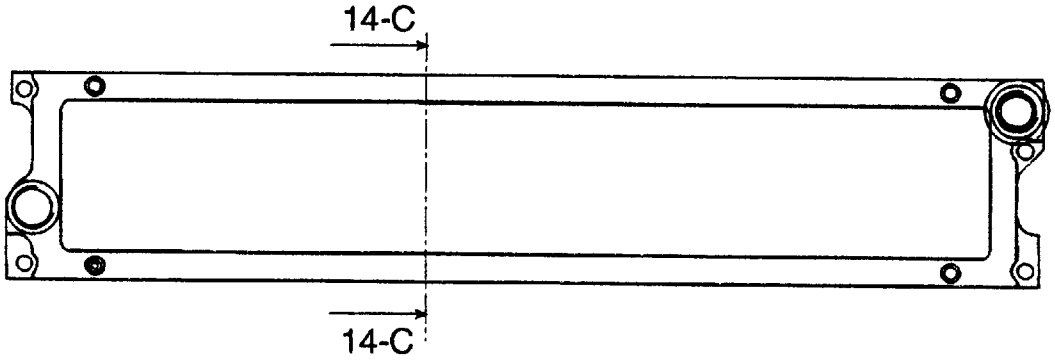
FIG. 14-B
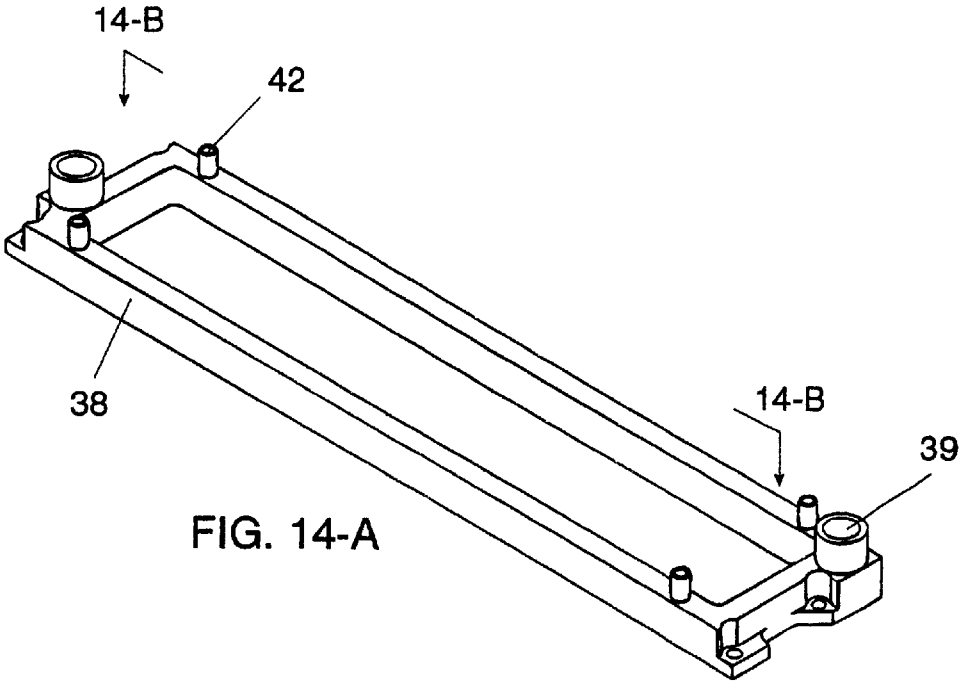
FIG. 14-A

INKJET PRINT HEAD

This is a continuation in part of U.S. patent application Ser. No. 09/330,217, filed Jun. 11, 1999, which is itself a continuation of U.S. patent application Ser. No. 08/276,572, filed Jul. 18, 1994, now issued as U.S. Pat. No. 5,940,099.

FIELD AND BACKGROUND OF THE INVENTION

The present invention relates to inkjet printers and, in particular, it concerns print head configurations for such printers.

Impulse inkjet systems are well known in the art. They generally fall into two categories: continuous systems and drop on demand systems. Continuous inkjet systems operate by continuously ejecting ink droplets at high frequency, some of which are deflected by suitable means prior to reaching the substrate being imprinted, allowing the undeflected drops to form the desired imprinting pattern. Drop on demand systems eject drops selectively as required.

Drop on demand inkjet systems may, in turn, be divided into two general categories on basis of the principle of ejecting the droplets. Most systems in use today are the thermal bubble jet type wherein the ejection of ink droplets is effected by boiling of the ink.

Thermal bubble system, like the one disclosed in Japanese patent application No. 61-59913, includes thermoelectric heating elements. Actuation of a specific element causes the ink in that cavity to boil which causes a sudden rise in pressure, thus ejecting an ink drop through the nozzle. Bubble jet printing systems are advantageous in the ease of their miniaturization. On the other hand, they suffer some disadvantages relative to piezoelectric systems. One such disadvantage is the short useful life of the heating elements due to the high stresses imposed on the resistor protecting layer. In addition, it is relatively difficult to control precisely the volume of the drop and its directionality.

Still another drawback is the low frequency of printing signals which may be applied consistently to the printing head. Still another drawback of the thermal bubble system is that it is limited to special ink formulations which can withstand boiling temperature without mechanical or chemical degradation.

Other drop-on-demand inkjet systems use piezoelectric crystals which deform when a voltage is applied to them, thereby causing the ejection of a drop of ink from an adjoining ink cavity, as will be shown below. Ink is fed to the cavity through a restricted inlet opening, and leaves the cavity through a nozzle. The relative fluid impedance of the restricted inlet opening and the nozzle is such that a suitable amount of ink exits the outlet nozzle during the bending of the diaphragm. Replenishment of the cavity with ink is a result of the capillary action of the ink meniscus in the nozzle and the return motion of the diaphragm. The time taken to replenish depends on the fluid impedance.

In contrast to thermal bubble systems, piezoelectric drivers are not required to operate at elevated temperatures, allowing them to accommodate a much wider selection of inks. Furthermore, the shape, timing and duration of the driving pulses are more easily controlled. Finally, the operational life of the piezoelectric crystal and hence the piezoelectric head is much longer.

Piezoelectric crystal drop-on-demand print heads are well known in the art. Some illustrative examples of such developments include U.S. Pat. Nos. 4,730,197 and 5,087,930.

These patents disclose a construction having a series of stainless steel layers. The layers are of various thickness and include various openings and channels. The various layers are stacked and bonded together to form a suitable fluid inlet channel, pressure cavity, fluid outlet channel and orifice plate.

The systems disclosed in the above referenced patents illustrate the use of a fluid inlet channel having a very small aperture, typically 100 microns or less. The use of a very small aperture is dictated by the need to limit the back flow from the ink cavity during ejection of a drop. On the other hand, it is problematic in that the small aperture is susceptible to clogging during the bonding of the layers as well as during normal operation of the print head. Additionally, the techniques used for forming the openings in the orifice plate, which typically include punching, chemical etching or laser drilling, require that the thickness of the orifice plate be equal to, or less than, the orifice diameter, which is itself limited by resolution considerations to about 50 microns. Finally, any air bubbles or other gaseous substance trapped in the flow channels cannot easily be purged, and because bubbles are compressible, their presence in the system can have detrimental effects on the system performance.

Piezoelectric elements are used in inkjet heads in various configurations, each having its implications for the cavity construction. Some examples are: a layered type, as shown schematically in FIG. 53 of U.S. Pat. 5,666,141, in which a rod shaped layered element extends longitudinally as a result of voltage applied to the electrodes, causing a pressure surge in the ink cavity. Another conventional configuration, known as the bimorph-cantilever type, is shown schematically in FIG. 54 of U.S. Pat. No. 5,666,141. In this case, two electrodes are cemented to a piezoelectric element forming a thin leaf. A voltage applied to the electrodes causes the leaf to bend, thereby ejecting a single drop. In more recently developments, the piezoelectric element is typically cemented to a thin plate forming a diaphragm located above the ink cavity.

Two approaches are used to achieve full print coverage of the printed substrate: the conventional construction uses a small printing head containing a limited number of cavities and nozzles (sometimes as low as a single nozzle), each nozzle printing a specific row. To achieve full coverage the printing head is being moved to-and-for while ejecting ink droplets. Each movement of the printing head corresponds to a strip of printed lines, typically one for each nozzle in the head. The printed substrate is also moved forward in steps, the width of the step depending on the number of printing nozzles. This mechanism is commonly used in desk printers and the like. Its main disadvantages are the limited printing speed and the high noise level it produces.

The second approach, to which the present invention primarily relates, is the full array approach. According to this approach, each pixel across one dimension of the substrate is covered by a specific nozzle. Although this approach necessitates a large number of nozzles, it can achieve very high printing speed and silent operation.

In order to provide high nozzle densities over a small area, conventional inkjet print heads are typically formed on silicon or ceramic wafers by use of masking or etching techniques. The use of such wafers renders the structures uneconomical for implementing large two-dimensional arrays of cavities.

As an alternative to the use of a constricted fluid inlet channel aperture with its associated problems mentioned above, it has been suggested that suitable ink flow impedance could be combined with advantageous filtering properties by passing the ink into the cavities through a porous layer. The principles of this approach are described in the parent application of this application, now issued as U.S. Pat. No. 5,940,099 to the present applicant. In order to achieve high quality uniform printing, it is important that the ink supply to the porous layer should uniform with respect to the cavities. However, the parent patent does not address details of how to achieve uniformity of ink supply across the porous layer for large two-dimensional nozzle arrays.

A further issue relating to inkjet print head design is the choice of material for the front face of the printing head. For a range of reasons including mechanical and chemical properties and ease of production, polyimide compositions are frequently preferred. However, it has been found that a polyimide front surface has a tendency to collect small splashes of ink and other residues, leading to inferior printing quality and reduced reliability.

There is therefore a need for an inkjet print head which provides an improved ink supply through a porous layer to a plurality of ink cavities. It would also be highly advantageous to provide an inkjet print head with a polyimide-based nozzle plate which would avoid build-up of ink on the front surface.

SUMMARY OF THE INVENTION

The present invention is an inkjet print head.

The present invention provides an inkjet printing head capable of high printing speed, high reliability, and having the ability to use many kinds of ink formulations.

In most preferred implementations, these properties are achieved, amongst other features, by using an ink supply layer including porous material. Preferably, the porous material includes sintered material, most preferably sintered stainless steel.

The ejection of an ink drop is accomplished as follows: a pressure pulse is imparted to a volume of ink in an ink cavity through the deflection of a thin deflection plate located on top of the ink cavity. The plate is deflected downwards by the action of a piezoelectric element whenever a voltage is applied across its electrodes, one of which is in electrical contact with the metallic deflection plate. The pressure pulse created by the downwards bending of the deflection plate drives the ink through the nozzle, thus causing the ejection of an ink droplet of specific size.

When the piezoelectric element is de-energized it returns to its equilibrium position, reducing the pressure in the ink cavity and causing the meniscus at the end of the nozzle to retract. The retracted meniscus generates a capillary force in the nozzle which acts to pull ink from the porous material into the cavity. The refilling process ends when the meniscus regains its equilibrium position.

A key element in preferred implementations of a print head according to the present invention is the presence of the porous material which acts as hydraulic linkage between the ink main supply and the individual ink cavities. Proper selection of the porous material, grain size, pore size, type of alloy and the machining processes imparts the plate with proper flow impedance values as well as making it an efficient filter.

It will be readily appreciated that in order to achieve high drop ejection rate, the time required to refill the ink cavity following ejection of a drop must be as short as possible. The refilling time can be reduced by reducing the restriction to flow into the cavity. However, reduction of the restriction to inflow tends to increase the adverse effects of cross talk, i.e., the undesired interaction between separate ink cavities.

The optimization of the system in terms of conflicting requirements of low cross talk and high refill rate can be effected through the judicious selection of a porous material having optimal characteristics for the intended application, taking into account, in addition, the viscosity of the ink and the nozzle geometry.

As stated above, the optimal balance between the in-flow of ink into the ink cavity and out-flow to neighboring cavities depends also upon the ink viscosity and nozzle dimension. The lower the viscosity of the ink, the faster the refilling rate of the ink cavity will be, but the more pronounced will be the cross talk between separate cavities. Also, the smaller the outlet nozzle diameter, the more pronounced will be the capillary action of the nozzle and hence, the higher the refilling rate.

Inkjet print heads are generally designed so that the dimensions of the ink channels have acoustic impedance which is optimal for a specific ink of a given viscosity and for a specific nozzle diameter. If it is desired to use a print head with a different nozzle diameter and/or with ink of a different viscosity, conventional print head channels must be redesigned to accommodate the new nozzle diameter and/or different viscosity. By contrast, use of a porous material according to the present invention, makes it possible to preserve the same print head geometry and structure even when ink of a different viscosity and/or when a different nozzle geometry are to be used.

The optimization of the acoustic impedance of the channels can be effected merely through the proper selection of a suitable porous material having suitable characteristics, such as a suitable micron grade.

Apart from the ability to optimize the print head without the need to redesign the flow channels, use of a porous material according to the present invention eliminates the small, and easily clogged, ink inlet apertures used to supply ink to the cavities of conventional inkjet print heads.

Still another advantage offered by the use of the porous material according to the present invention is the material ability to act as filter, thereby reducing, or even completely obviating, the need for special filtration of the in-flow ink.

Finally, the fabrication of print heads including porous material according to the present invention can be effected using simple production techniques without the need for complex and expensive micro-machining.

According to the teachings of the present invention there is provided, an inkjet printing head comprising: (a) a nozzle layer defining a plurality of ejection nozzles; (b) a cavity layer having a plurality of apertures, each aperture being positioned to correspond to one of the ejection nozzles so as to at least partially define a corresponding ink cavity; and (c) an ink supply layer having a front surface associated with the nozzle layer and a rear surface associated with the cavity layer, the ink supply layer being formed with a plurality of connecting bores from the rear surface to the front surface, each connecting bore being aligned so as to connect between a corresponding one of the ink cavities and a corresponding one of the ejection nozzles, wherein the ink supply layer is formed from a porous material having a multitude of small interconnected pores so as to allow passage of ink therethrough, wherein the ink supply layer additionally features: (i) a pattern of ink distribution channels formed in the front surface, and (ii) at least one ink inlet bore passing from the rear surface to the front surface and configured so as to be in direct fluid communication with at least part of the pattern of ink distribution channels, the pattern of ink distribution channels and the at least one ink inlet bore together defining part of an irk flow path which passes from the rear surface through the at least one ink inlet bore to the pattern of ink distribution channels on the front surface, and through the porous material to the plurality of ink cavities.

According to a further feature of the present invention, the at least one ink inlet bore is implemented as a plurality of ink inlet bores spaced around a peripheral edge of the ink supply layer.

According to a further feature of the present invention, each of the ink inlet bores is angled such that the intersection of the ink inlet bore with the rear surface of the ink supply layer occurs at a position nearer to the peripheral edge than the intersection of the ink inlet bore with the front surface of the ink supply layer.

According to a further feature of the present invention, there is also provided a rigid casing rigidly attached to the nozzle layer, the ink supply layer and the cavity layer, the rigid casing being formed with a plurality of ink conduits, each of the plurality of ink conduits being configured to supply ink to a corresponding one of the plurality of ink inlet bores of the ink supply layer.

According to a further feature of the present invention, the plurality of connecting bores define an array on the front surface having two row directions, and wherein the pattern of ink distribution channels includes a plurality of channels deployed substantially parallel to one of the row directions and interposed between adjacent rows of the connecting bores.

BRIEF DESCRIPTION OF THE DRAWINGS

The invention is herein described, by way of example only, with reference to the accompanying drawings, wherein:

FIGS. 1A and 1B are two parts of an exploded isometric view of an inkjet printing head, constructed and operative according to the teachings of the present invention, showing its various layers;

FIG. 1C is a partial, enlarged, schematic cross-sectional view taken through the assembled inkjet printing head of FIGS. 1A and 1B, showing an ink cavity;

FIG. 1D is a schematic representation of the control circuitry of the inkjet printing head of FIGS. 1A and 1B;

FIG. 2A is a plan view of a nozzle plate from the inkjet printing head of FIGS. 1A and 1B;

FIG. 2B is an enlarged, partial cross-sectional view showing a preferred structure of a nozzle from the nozzle plate of FIG. 2A;

FIG. 2C is an enlarged view of a part of FIG. 2A showing a preferred staggered arrangement of nozzles;

FIGS. 4A and 4B are, respectively, a plan view and a side view of an assembly of the nozzle plate of FIG. 2A and a porous layer;

FIG. 4C is an enlargement of the similarly labeled region of FIG. 4B;

FIG. 5A is an upper plan view of the porous layer of the inkjet printing head of FIGS. 1A and 1B;

FIG. 5B is a partial, enlarged, cross-sectional view taken along the line similarly labeled in FIG. 5A;

FIG. 5C is a lower plan view of the porous layer of FIG. 5A;

FIG. 5D is an enlarged, split-level, cross-sectional view taken along the line similarly labeled in FIG. 5A;

FIG. 5E is an enlargement of the similarly labeled region of FIG. 5C;

FIG. 6A is a plan view of a tripartite cavity layer of the inkjet printing head of FIGS. 1A and 1B;

FIG. 6B is a partial, enlarged, cross-sectional view taken along the line similarly labeled in FIG. 6A;

FIGS. 8A–8C are, respectively, a lower plan view, a side view, and an upper plan view of an assembly of the deflection plate of FIG. 7 with its piezoelectric elements in place together with the layer elements of FIGS. 2–6;

FIG. 8D is a partial, enlarged cross-sectional view of the layered structure of FIGS. 8A–8C;

FIG. 8E is an enlarged view of the similarly labeled region of FIG. 8C;

FIG. 9A is a plan view of a contact layer, including a plurality of conductive connecting elements, from the inkjet printing head of FIGS. 1A and 1B;

FIG. 9B is a split-level cross-sectional view taken along the line similarly labeled in FIG. 9A;

FIGS. 9C and 9D are enlargements of the similarly labeled regions of FIG. 9B;

FIGS. 12A and 12B are an isometric view and a plan view, respectively, of a main heat sink from the inkjet printing head of FIGS. 1A and 1B;

FIG. 12C is a cross-sectional view taken along the similarly labeled line in FIG. 12B;

FIGS. 13A and 13B are upper and lower isometric views, respectively, of a print head casing from the inkjet printing head of FIGS. 1A and 1B;

FIG. 13C is a cross-sectional view along the line similarly labeled in FIG. 13B;

FIG. 14A is an isometric view of an ink manifold from the inkjet printing head of FIGS. 1A and 1B;

FIG. 14B is a plan view of the ink manifold of FIG. 14A;

FIG. 14C is a cross-sectional view along the line similarly labeled in FIG. 14B;

DESCRIPTION OF THE PREFERRED EMBODIMENTS

Figure 3:
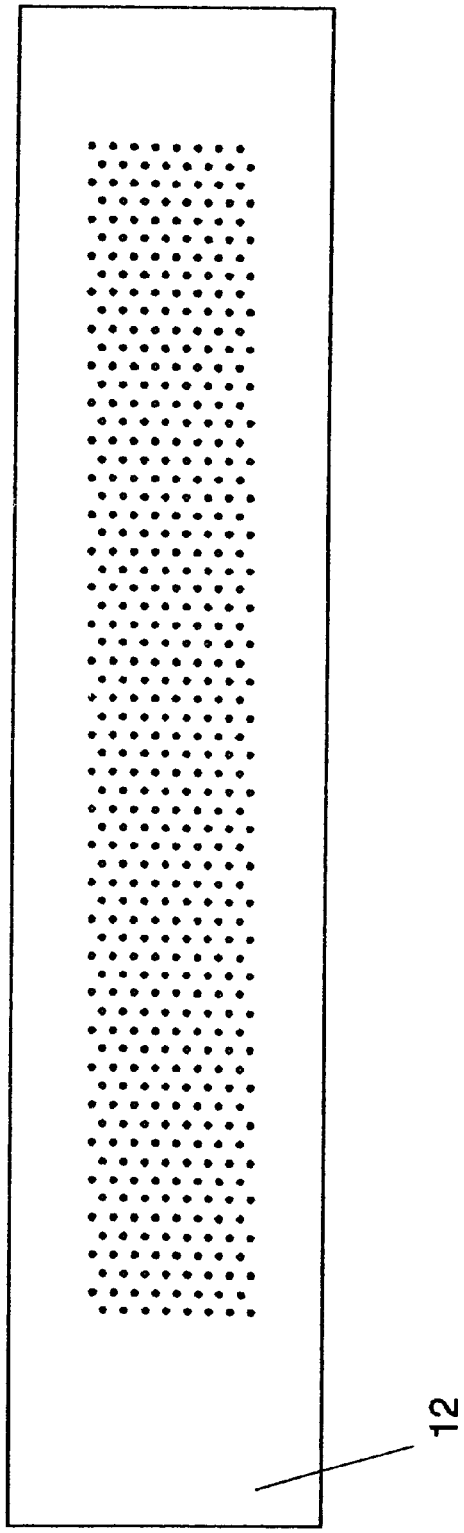
FIG. 3 is a plan view of an adhesive layer used between the nozzle plate of FIG. 2A and a porous plate of the inkjet printing head of FIGS. 1A and 1B.

The present invention is an inkjet print head.

The principles and operation of inkjet print heads according to the present invention may be better understood with reference to the drawings and the accompanying description.

Referring now to the drawings, FIGS. 1–15 illustrate the structure and components of an inkjet printing head, generally designated 100, constructed and operative according to the teachings of the present invention.

Generally speaking, inkjet printing head 100 has a nozzle layer 10 defining a plurality of ejection nozzles 102, and a cavity layer 18 having a plurality of apertures 104, positioned to correspond to positions of ejection nozzles 102 so as to at least partially define a corresponding ink cavity. Inkjet printing head 100 also has an ink supply layer 14 having a front surface 106 associated with nozzle layer 10 and a rear surface 108 associated with cavity layer 18. Ink supply layer 14 is formed with a plurality of connecting bores 56 from rear surface 108 to front surface 106, each aligned so as to connect between a corresponding ink cavity and a corresponding ejection nozzle 102. Ink supply layer 14 is formed from a porous material having a multitude of small interconnected pores so as to allow passage of ink therethrough.

According to certain preferred implementations of the present invention, ink supply layer 14 additionally features a pattern of ink distribution channels 52, 54 (FIGS. 5B–5D) formed in front surface 106, and at least one ink inlet bore 50 passing from rear surface 108 to front surface 106 and configured so as to be in direct fluid communication with at least part of the pattern of ink distribution channels 52, 54. The pattern of ink distribution channels 52, 54 and the at least one ink inlet bore 50 together define part of an ink flow path which passes from rear surface 108 through ink inlet bore 50 to ink distribution channels 52, 54 on front surface 106, and through the porous material of layer 14 to the ink cavities.

It will readily be apparent that the ink flow path as herein described is particularly effective for providing a sufficient and generally uniform ink supply to the porous layer across an entire array of ink cavities. Specifically, by defining an ink flow path which extends from the front surface to the rear surface of the porous layer, effective use is made of the volume of the porous material. At the same time, the combination of ink inlet bore 50 and ink distribution channels 52, 54 allows distribution of ink across front surface 106 from an ink supply positioned <u>behind</u> the porous layer, thereby avoiding obstruction or undue complication of the nozzle structure.

It will also be apparent that the print head structure described herein provides a practical structure which can be implemented by standard machining production techniques without the need for masking and etching wafer production techniques. This is primarily due to the fact that the print head structure of the present invention avoids the need for the very precise constricted inlet aperture to each cavity required by the prior art. As a result, the structure can be extended economically to a nozzle array of essentially unlimited extent in each of two-dimensions.

It should be noted that, although reference is made throughout the description to inkjet printing systems, applications of the present invention are not limited to the ejection of ink, and that systems and methods according to the present invention may be used for ejection of large variety of incompressible fluids or liquids in a controlled pattern.

Before addressing the features of the invention in more detail, it will be helpful to clarify certain terminology which will be used herein in the description and claims. Firstly, reference is made to the "front" and "back" of various components. Unless otherwise specified, the term "front" is used to refer to the part of a component which, when the print head is assembled, lies closest to the substrate upon which ink is deposited. Accordingly, the term "back" is used to refer to the part furthest from the substrate when assembled. The terms "top" and "bottom" on the other hand are used for the sake of clarity in the intuitive sense of parts which appear upward facing or downward facing, respectively, in the views of FIGS. 1A, 1B and 1C.

Front surface 106 and rear surface 108 are described as being "associated with" nozzle layer 10 and cavity layer 18, respectively. It should be noted that the phrase "associated with" is used in this context to refer to attachment, whether direct or indirect. As will be clear from the description of the preferred embodiment below, the attachment is preferably achieved by including one or more intermediate layer of adhesive material between each pair of elements. The terminology should also not be taken to exclude the possibility of additional layers interposed between the recited elements.

Turning now to the features of the present invention in more detail, a preferred implementation of ink supply layer 14 is shown in FIGS. 5A–5E. Preferably, the at least one ink inlet bore 50 is implemented as a plurality of ink inlet bores 50 spaced around a peripheral edge of ink supply layer 14 as seen in FIG. 5A. In a preferred implementation, each ink inlet bore 50 is angled as seen in FIG. 5D such that its intersection with rear surface 108 occurs at a position nearer to the peripheral edge of ink supply layer 14 than its intersection with front surface 106. This facilitates peripheral connection of ink inlet bores 50 to the previous stage of the ink flow path, as will be described below with reference to FIG. 16.

The location of ink distribution channels 52, 54 on front surface 106 ensures that ink flow through the porous material of ink supply layer 14 occurs through the bulk of the layer. It is a particular feature of most preferred implementations of the present invention that ink distribution channels 52, 54 are distributed over front surface 106 in such a pattern that each connecting bores 56 is approximately the same distance from its nearest ink distribution channel. In the typical case that connecting bores 56 define an array on front surface 106 having two row directions, the pattern of ink distribution channels preferably includes a plurality of channels 54 deployed substantially parallel to one of the row directions and interposed between adjacent rows of connecting bores 56 as shown in FIG. 5E. Channels 52 interconnect channels 54 to ensure pressure equalization and effective distribution of ink across front surface 106.

As mentioned above, the inlet end of ink inlet bores 50 are preferably disposed along a peripheral edge of ink supply layer 14. This facilitates a number of additional preferred features of the present invention according to which ink is supplied to ink inlet bores 50 from conduits formed within a rigid casing of the print head. This feature will be discussed in detail below with reference to FIGS. 4C and 16.

Turning now to nozzle layer 10, this is best seen in FIGS. 1C and 2A–2C. Nozzle layer 10 may be made from a range of materials including, but not limited to, stainless steel (such as AISI 302 or AISI 304) and polyimide. Polyimide is particularly preferred due to the ease by which it is machined by laser and its favorable physical and chemical properties.

Nozzle layer 10 is typically made of a thin polymide sheet of approximately 50 micron thickness.

FIG. 2B shows a preferred form of a single nozzle. Nozzles of the form shown here were found to produce drops having consistent volume.

Referring briefly to FIG. 2C, it will be seen that ejection nozzles 102 are disposed in staggered rows. In a typical non-limiting example, the present invention provides a print head having 6 inches width coverage and printing resolution of 600 DPI (Dots Per Inch). The basic module consists of 512 nozzles staggered in an accurate amount, in a 32×16 array, as will be discussed hereinafter. The amount of staggering between two adjacent rows for such an example is typically R=0.042 mm for a required resolution of 600 DPI (25.4 mm/600=0.042 mm). It will be noted that the columns of the nozzles are also staggered in the same amount, in this case, S=0.042 mm, thus forming a bi-axially staggered array of nozzles. This staggering technique is explained in U.S. Pat. No. 6,345,879 entitled "Bi-Axial Staggered Array" to the same assignee as the present invention.

Turning now to the remaining features of inkjet print head 100, FIG. 1C shows the overall layer structure associated with a single cavity and its actuation system. Each element can be seen in isometric view in FIGS. 1A and 1B. Nozzle layer 10 and ink supply layer 14 are connected by an adhesive layer 12, while cavity layer 18 is formed as a sandwich with two adhesive layers 16 and 20. Adhesive layer 16 connects ink supply layer 14 to cavity layer 18 while adhesive layer 20 connects to a flat deflection plate 22 which covers the ink cavity. Layers 10, 12, 14, 16, 18 and 20 all feature coaxial bores of various shapes and diameters, together defining a cavity connected to an outlet nozzle as shown. Deflection plate 22 has a piezoelectric element 24 bonded thereto in alignment with the cavity by a thin electrically conductive adhesive (not shown). The aforementioned elements 10 through 24 may be viewed together as an ink delivery module having a front surface with a plurality of nozzles from which ink droplets are selectively ejected and a rear surface with an array of electrical contacts for selectively actuating ejection of the ink droplets.

Electrical connection to piezoelectric element 24 is achieved through a contact layer including an insulating plate 26 provided with an elastic electrically-conductive connecting element 27 projecting from two faces of plate 26 aligned with each piezoelectric element 24 and its corresponding actuating contact (conductive pad 35) on a printed circuit board 30. When a driver chip 31 on printed circuit board 30 is triggered to actuate a specific piezoelectric element, it generates a voltage pulse which is transmitted through conductive pad 35 to the conductive cones 27 and to the piezoelectric element 24. The piezoelectric element is grounded at its lower surface by the metallic deflection plate 22. The voltage pulse causes the piezoelectric element to deflect downwards, causing the deflection plate 22 to deflect locally. This deflection causes the volume of the ink in the cavity to decrease thereby a drop of ink is ejected through the nozzle. Termination of the voltage from the upper plane the piezoelectric element 24 causes the element to return to its equilibrium position and ink to flow into the cavity through the upper plane of ink supply layer 14.

Referring briefly to FIG. 1D, this shows schematically the ink ejection circuitry. Ink ejection control 40 is connected via a flat cable 41 and flat connector 43 to printed circuit board (PCB) 30. The data received by the PCB 30 is processed by drivers 31 and transformed into actuating voltages applied to the individual piezoelectric elements.

Referring now to FIG. 3, there is shown an adhesive layer 12, typically formed from an epoxy adhesive foil. Foil 12 is punched by a punch having the same number of punches as in the nozzle plate 10 and in the same pattern. In one typical example, the diameter of the holes is about 0.5 mm. Adhesive layer 12 is used to bond nozzle layer 10 to ink supply layer 14, and to isolate the nozzles from each other.

Referring now to FIGS. 4A–4C, nozzle plate 10 is shown bonded to ink supply layer 14 by adhesive layer 12. The typical end layout is shown enlarged in FIG. 4C. In a preferred implementation that casing 36 is formed from molded epoxy resin, the undercut profile formed by the edge of the layers as shown provides an effective anchoring site for casing 36 to form a strong and rigid unit. Ink supply layer 14 is used as a reservoir of ink for the ink cavities. Once an ink drop has been ejected from a specific cavity, the ink contained in the porous layer 14 around the said cavity is replenished through the upper plane of the layer.

Referring now to FIGS. 6A and 6B, there is shown a tripartite cavity assembly formed from adhesive layer 16, cavity layer 18 and another adhesive layer 20. The three layers are punched together to form the ink cavities. Additionally, the triple layer has two rows of through drills 58 which feed ink from the ink manifold 38 (described below) to the ink supply layer 14. Cavity layer 18 is typically made from polyimide foil, although many other materials may also be adequate like plastics, stainless steel foil and the like.

Figure 7:
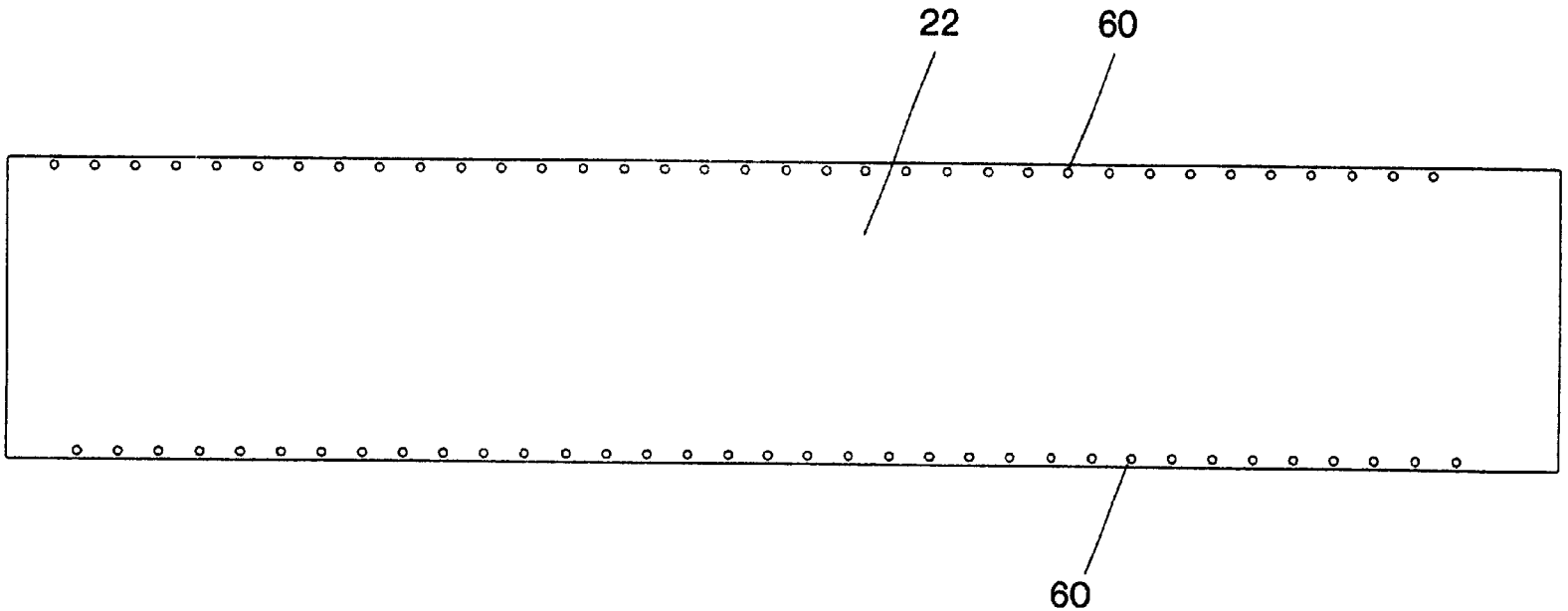
FIG. 7 is a plan view of a deflection plate of the inkjet printing head of FIGS. 1A and 1B.

Referring now to FIG. 7, deflection plate 22 is shown here after initial machining. It is typically made from stainless steel foil, 0.05 mm thick. Two rows of drill holes 60 located along the long side of the plate are used to supply ink from the ink manifold 38 (described below) to ink supply layer 14.

Referring now to FIGS. 8A–8E, these show the assembled ink delivery module, complete with piezoelectric elements 24 bonded onto the deflection plate 22 (see enlarged view of FIG. 8E). One technique for arranging the array of the piezoelectric elements 24 on the deflection plate 22 is by using a pattern to dispense adhesive drops onto the deflection plate and then to place individually the piezoelectric elements by using a "pick and place" robotic mechanism, which is well known in the art.

Referring now to FIGS. 9A–9D, there is shown a contact layer. This layer is used to conduct the electrical signals produced by the drivers 31 via the printed circuit pads 35 located at the bottom of the printed circuit board 30 to the upper electrode of the piezoelectric elements 24. The contact layer is formed from an isolator plate 26, which is punched in the same pattern as the ink cavities, and is used to locate two kinds of contacts: signal contacts 27 which conduct signals to piezoelectric elements 24, and ground contacts 28 located at the periphery of the contact layer. Typically, all contacts are formed from a special formulation compound having high electrical conductivity and also mechanical resiliency, so that the contacts maintain contact with the printed circuit pads 35 as well as with the piezoelectric elements 24. Each contact 27 is pressed against the rectangular piezoelectric element near its apex, as shown in FIG. 1C. This design ensures reliable contact between the contact 27 and the piezoelectric element 24 even when deflection occurs, and does not interfere with the deflection of the deflection plate. The contact layer itself is further described in U.S. Pat. No. 6,338,629, to the same assignee as the present invention.

Figure 10A:
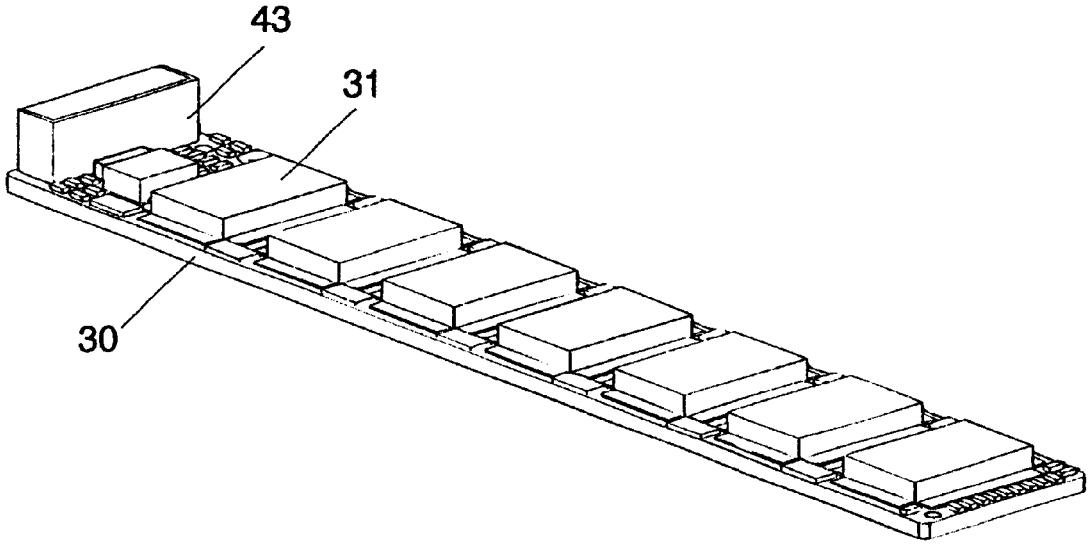
FIGS. 10A and 10B are upper and lower isometric views, respectively, of a printed circuit board from the inkjet printing head of FIGS. 1A and 1B.
Figure 10B:
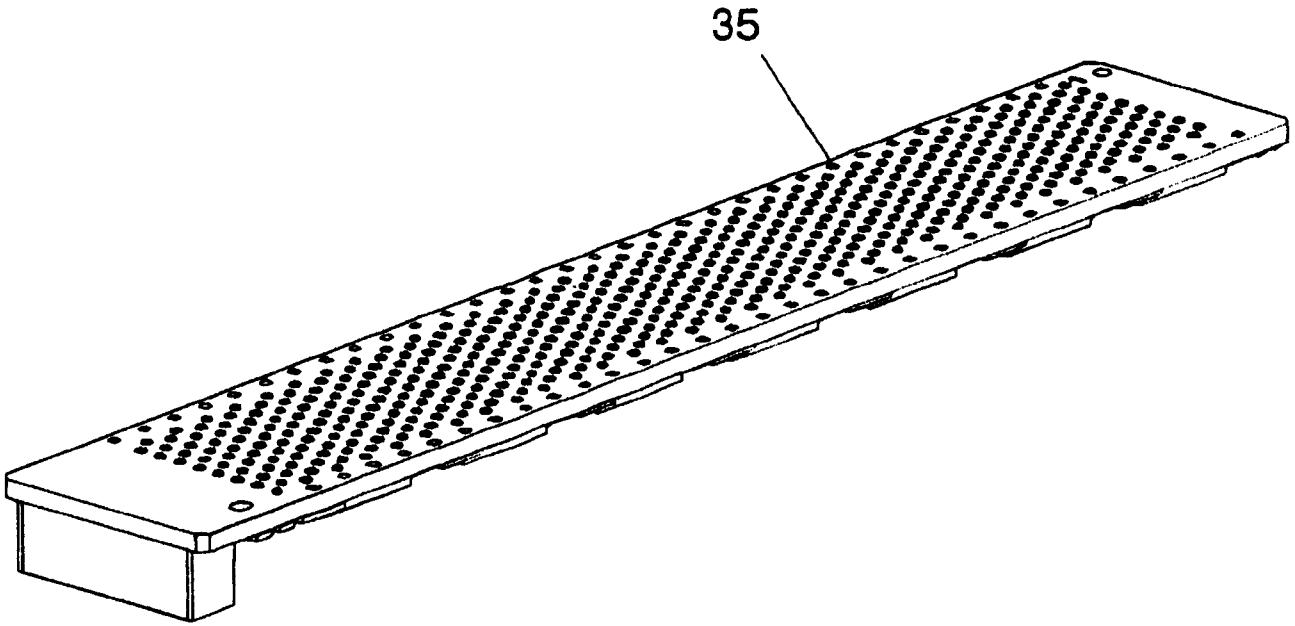

Referring now to FIGS. 10A and 10B, there is shown printed circuit board 30. The ink ejection control electronics 40 (shown in FIG. 1D), which is not per se part of this invention, sends control data to the specific PCB 30. This data is conducted via a flat cable 41 (shown in FIG. 1D) through a flat connector 43 to a number of electronic drivers 31, hereinafter referred to as drivers. Drivers 31, which are mounted on the PCB 30, are typically high voltage serial to parallel converters with a logic zone and a high voltage zone. The data transfer into the drivers is done at a high rate. When a trigger signal is received in the drivers, the appropriate piezoelectric elements 24 are actuated by high tension pulses, causing ejection of ink drops.

Figure 11:
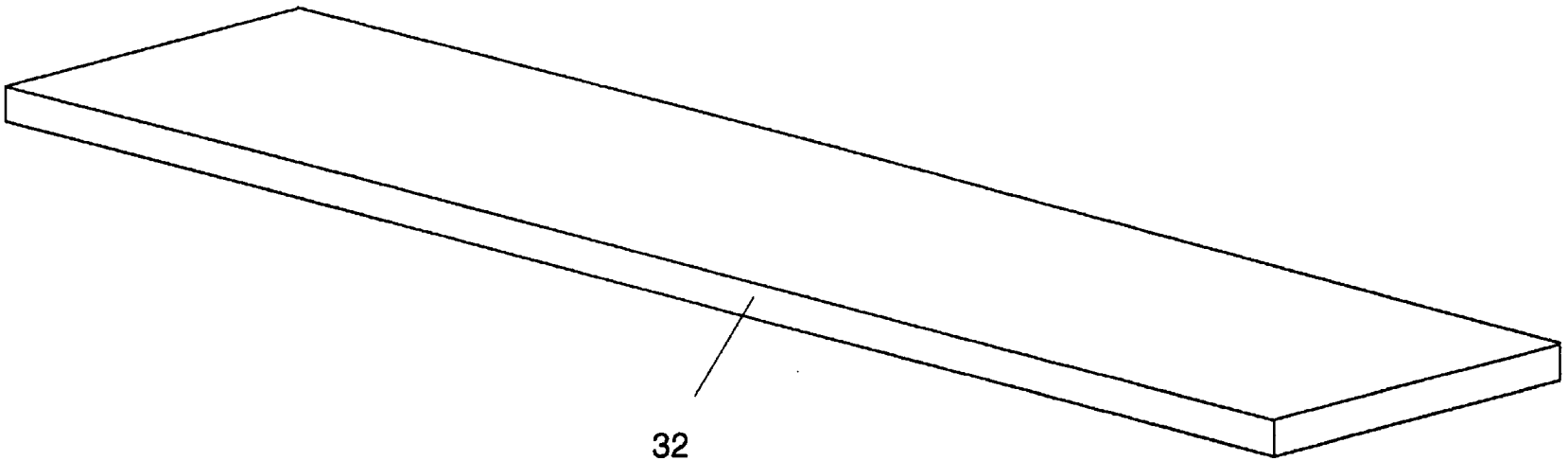
FIG. 11 is an isometric view of a resilient heat sink layer from the inkjet printing head of FIGS. 1A and 1B.

FIGS. 12A–12C show a metallic heat sink element for absorbing unwanted heat generated by drivers 31 and dispersing it by conduction, convection and radiation. The heat sink 34 is typically made from anodized aluminum. Heat sink element 34 is also used as an upper cover for the print head casing 36. FIG. 11 shows a resilient heat sink layer 32 for transferring thermal energy from drivers 31 to heat sink element 34. Heat-sink pad 32 is made from a resilient, heat conducting material such as "T-flex 200" or "T-flex 400" commercially available from Thermagon, Inc. (USA). The resilient properties of layer 32 allow it to conform to the top of the drivers 31 to ensure good thermal contact, as well as maintaining the pressure required between the PCB pads 35, the pads array 26, the deflection plate layer 22 and the piezoelectric elements 24.

Referring now to FIGS. 13A–13C, there is shown a casing 36 having an opening for receiving the contact layer and the printed circuit board. In one particularly preferred embodiment mentioned above with reference to FIG. 4C, casing 36 is formed from epoxy resin which is molded so as to engage the ink delivery module at its lower extent. Alternatively, casing 36 may be made from other materials, such as stainless steel, aluminum, or other metallic or plastic materials, with the ink delivery module attached thereto by any suitable means. Casing 36 is formed with inwardly projecting abutment features 37 configured for abutting the edges of PCB 30 so as to define a fully inserted position thereof. Casing 36 also serves to enable correct positioning of multiple modules in a row, imparts rigidity to the print head and maintains its sealing.

Two rows of holes 62 are formed, by drilling or molding as appropriate, through casing 36 spaced along its longer sides. As will be seen in FIG. 16, these are aligned with the peripheral holes of the set of layers forming the ink delivery module so as to feed ink from an ink manifold 38 (described below) through the ink delivery module to ink inlet bore 50 of ink supply layer 14.

Turning now to FIGS. 14A–14C, these show ink manifold 38. Ink manifold 38 is fed from an external ink supply through at least one, and in this case two, tubes 39 protruding from its ends. The ink flows through the two channels along the long side of the manifold into holes 62 of casing 36. The manifold 38 is bonded on top of casing 36. Four spacers 42 are used to locate studs 66, as shown in FIG. 1B.

Figure 15:
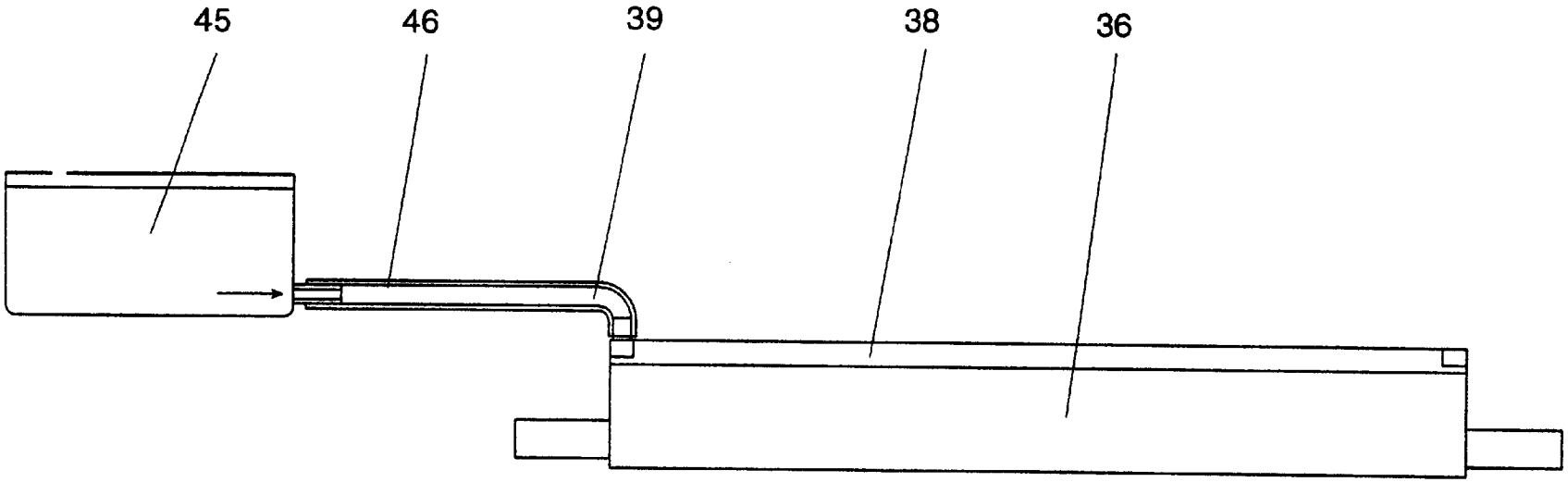
FIG. 15 is a schematic illustration of an ink supply system for the inkjet printing head of FIGS. 1A and 1B.

FIG. 15 shows schematically an external ink supply system for use with the present invention. An ink reservoir 45 is connected, typically via plastic tubes 46, to tubes 39 of ink manifold 38.

It will be appreciated that heat sink element 34 is configured for attachment to casing 36 in a predefined position chosen such that, when attached, the heat sink presses the printed circuit board 30 and the contact layer against the ink delivery module until PCB 30 becomes lodged against abutment features 37, thereby applying a predefined pressure to ensure effective electrical contact between the contact layer and the contacts of both the ink delivery module and the printed circuit board without damaging the components. With specific reference to FIG. 1B, the heat sink is, in the example shown, fastened to the casing 36 by use of four studs 66, four springs 68 and four nuts 70 (only one of the four fasteners being shown for clarity). This design imparts the module with the required, yet adjustable, contact pressure between heat sink element 34, heat sink pad 32 and drivers 31.

Figure 16:
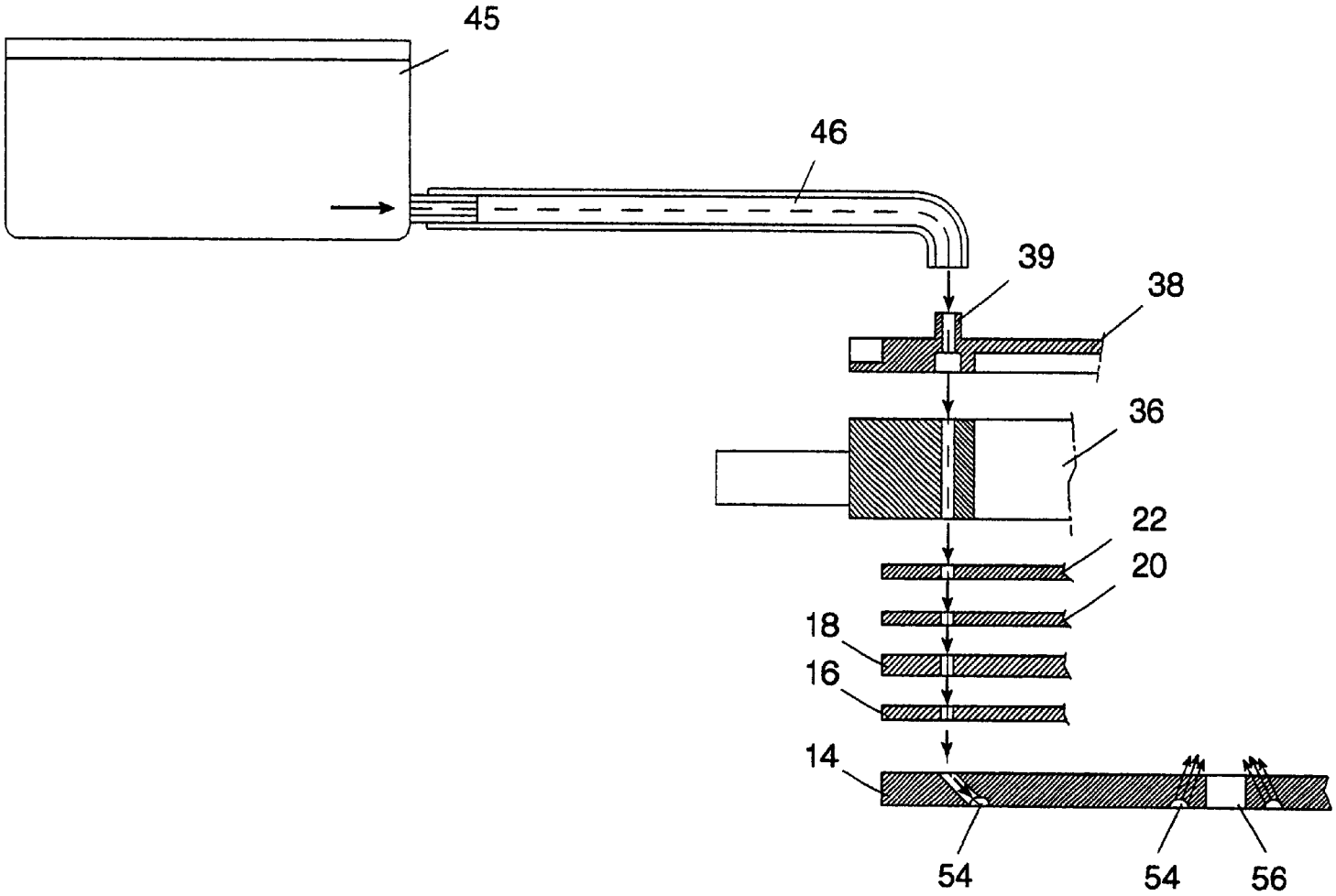
FIG. 16 is a partial, exploded cross-sectional view taken through the inkjet printing head of FIGS. 1A and 1B, showing an ink flow path.

Turning finally to FIG. 16, the full ink flow path from the external ink supply to the ink cavities of the print head will now be understood. The ink passes from external ink reservoir 45 through flexible tube 46 to inlet tubes 39 of manifold 38. The ink flows through the two channels along the long sides of the manifold into holes 62 of casing 36, and from there, enters the aligned holes formed through deflection plate 22, adhesive layer 20, cavity layer 18, and adhesive layer 16 to reach ink inlet bore 50 of ink supply layer 14. From this point, ink passes through ink inlet bore 50 to ink distribution channels 52, 54 on front surface 106, and through the porous material of layer 14 to the ink cavities.

It will be appreciated that the above descriptions are intended only to serve as examples, and that many other embodiments are possible within the spirit and the scope of the present invention.

What is claimed is:

1. An inkjet printing head comprising:

(a) a nozzle layer defining a plurality of ejection nozzles;

(b) a cavity layer having a plurality of apertures, each aperture being positioned to correspond to one of said ejection nozzles so as to at least partially define a corresponding ink cavity; and (c) an ink supply layer having a front surface associated with said nozzle layer and a rear surface associated with said cavity layer, said ink supply layer being formed with a plurality of connecting bores from said rear surface to said front surface, each connecting bore being aligned so as to connect between a corresponding one of said ink cavities and a corresponding one of said ejection nozzles, wherein said ink supply layer is formed from a porous material having a multitude of small interconnected pores so as to allow passage of ink therethrough, wherein said ink supply layer additionally features:

(i) a pattern of ink distribution channels formed in said front surface, and (ii) at least one ink inlet bore passing from said rear surface to said front surface and configured so as to be in direct fluid communication with at least part of said pattern of ink distribution channels, said pattern of ink distribution channels and said at least one ink inlet bore together defining part of an ink flow path which passes from said rear surface through said at least one ink inlet bore to said pattern of ink distribution channels on said front surface, and through said porous material to said plurality of ink cavities.

2. The inkjet printing head of claim 1, wherein said at least one ink inlet bore is implemented as a plurality of ink inlet bores spaced around a peripheral edge of said ink supply layer.

3. The inkjet printing head of claim 2, wherein each of said ink inlet bores is angled such that the intersection of said in inlet bore with said rear surface of said ink supply layer occurs at a position nearer to said peripheral edge than the intersection of said ink inlet bore with said front surface of said ink supply layer.

4. The inkjet printing head of claim 2, further comprising a rigid casing rigidly attached to said nozzle layer, said ink supply layer and said cavity layer, said rigid casing being formed with a plurality of ink conduits, each of said plurality of ink conduits being configured to supply ink to a corresponding one of said plurality of ink inlet bores of said ink supply layer.

5. The inkjet printing head of claim 1, wherein said plurality of connecting bores define an array on said front surface having two row directions, and wherein said pattern of ink distribution channels includes a plurality of channels deployed substantially parallel to one of said row directions and interposed between adjacent rows of said connecting bores.

6. An inkjet printing head having an ink supply layer, said ink supply layer comprising:

a pattern of ink distribution channels formed in a front surface associated with a nozzle layer; and at least one ink inlet bore passing from a rear surface associated with a cavity layer to said front surface, said at least one ink bore is configured so as to be in direct fluid communication with at least part of said pattern of ink distribution channels.

7. The inkjet printing head of claim 6, wherein said at least one ink inlet bore is implemented as a plurality of ink inlet bores spaced around a peripheral edge of said ink supply layer.

8. The inkjet printing head of claim 7, wherein each of said ink inlet bores is angled such that the intersection of said ink inlet bore with said rear surface occurs at a position nearer to said peripheral edge than the intersection of said ink inlet bore with said front surface.

9. The inkjet printing head of claim 7, further comprising a rigid casing rigidly attached to said nozzle layer, said ink supply layer and said cavity layer, said rigid casing being formed with a plurality of ink conduits, each of said plurality of ink conduits being configured to supply ink to a corresponding one of said plurality of ink inlet bores.

10. The inkjet printing head of claim 6, wherein said plurality of connecting bores define an array on said front surface having two row directions, and wherein said pattern of ink distribution channels includes a plurality of channels deployed substantially parallel to one of said row directions and interposed between adjacent rows of said connecting bores.

11. An ink supply layer for an inkjet printing head comprising:

a pattern of ink distribution channels formed in a front surface associated with a nozzle layer; and at least one ink inlet bore passing from a rear surface associated with a cavity layer to said front surface, said at least one ink bore is configured so as to be in direct fluid communication with at least part of said pattern of ink distribution channels.

* * * * *

UNITED STATES PATENT AND TRADEMARK OFFICE

CERTIFICATE OF CORRECTION

PATENT NO. : 6,439,702 B1
DATED : August 27, 2002
INVENTOR(S) : Karlinski, Haggai et al.

It is certified that error appears in the above-identified patent and that said Letters Patent is hereby corrected as shown below:

Title page,
Item [63], Related U.S. Application Data, should read:

-- Continuation-in-part of application No. 09/330,217, filed on Jun. 11, 1999, which is a continuation of application No. 08/276,572, filed on Jul. 18, 1994, now Pat. No. 5,940,099, which claims benefit of Israeli application 106803, filed Aug. 15, 1963. --

Signed and Sealed this

Sixth Day of May, 2003

JAMES E. ROGAN
*Director of the United States Patent and Trademark Office*